US008272370B2

(12) United States Patent
Maier et al.

(10) Patent No.: US 8,272,370 B2
(45) Date of Patent: Sep. 25, 2012

(54) FUEL INJECTOR

(75) Inventors: Martin Maier, Moeglingen (DE); Johann Bayer, Strullendorf (DE); Christian Suenkel, Altenkunstadt (DE); Wolfgang Koschwitz, Litzendorf (DE)

(73) Assignee: Robert Bosch GmbH, Stuttgart (DE)

( * ) Notice: Subject to any disclaimer, the term of this patent is extended or adjusted under 35 U.S.C. 154(b) by 672 days.

(21) Appl. No.: 11/991,047

(22) PCT Filed: Aug. 1, 2006

(86) PCT No.: PCT/EP2006/064877

§ 371 (c)(1),
(2), (4) Date: Sep. 23, 2009

(87) PCT Pub. No.: WO2007/023069

PCT Pub. Date: Mar. 1, 2007

(65) Prior Publication Data

US 2010/0006068 A1 Jan. 14, 2010

(30) Foreign Application Priority Data

Aug. 26, 2005 (DE) ..... 10 2005 040 363

(51) Int. Cl.
*F02M 51/06* (2006.01)
*F02M 61/16* (2006.01)

(52) U.S. Cl. ..... 123/472; 239/585.1

(58) Field of Classification Search ..... 239/533.2, 239/585.1, 583, 584, 600, 900; 123/470, 123/472; 285/305, 382, 382.4, 382.5, 921; 403/282, 292

See application file for complete search history.

(56) References Cited

U.S. PATENT DOCUMENTS

| | | | | |
|---|---|---|---|---|
| 4,589,596 | A * | 5/1986 | Stumpp et al. | 239/397.5 |
| 4,938,193 | A * | 7/1990 | Raufeisen et al. | 123/470 |
| 5,345,913 | A * | 9/1994 | Belshaw et al. | 123/470 |
| 5,775,600 | A * | 7/1998 | Wildeson et al. | 239/585.4 |
| 6,543,137 | B1 * | 4/2003 | Noller et al. | 29/890.124 |
| 6,988,681 | B2 * | 1/2006 | Reiter | 239/584 |
| 7,389,952 | B2 * | 6/2008 | Dallmeyer | 239/585.1 |
| 7,930,825 | B2 * | 4/2011 | Fochtman et al. | 29/890.131 |
| 2003/0164411 | A1 * | 9/2003 | Reiter | 239/533.12 |
| 2007/0095745 | A1 * | 5/2007 | Sebastian | 210/439 |
| 2008/0264389 | A1 * | 10/2008 | Fochtman et al. | 123/470 |

FOREIGN PATENT DOCUMENTS

| | | |
|---|---|---|
| DE | 199 00 405 | 7/2000 |
| DE | 103 34 785 | 2/2005 |
| WO | 02/061269 | 8/2002 |
| WO | 2005/019641 | 3/2005 |

* cited by examiner

*Primary Examiner* — Stephen K Cronin
*Assistant Examiner* — Arnold Castro
(74) *Attorney, Agent, or Firm* — Kenyon & Kenyon LLP

(57) ABSTRACT

A fuel injector for fuel injection systems of internal combustion engines is described. The fuel injector includes an electromagnetic actuating element having a magnetic coil, a core and a valve jacket as the outer magnetic circuit component and a movable valve-closure member which interacts with a valve-seat surface assigned to a valve-seat member. The core and a connecting tube in an inner opening of a thin-walled valve sleeve and the valve jacket on the outer circumference of the valve sleeve are firmly connected to the valve sleeve by pressing them therein/thereon. The fixed press connection between two of these metallic components of the fuel injector is characterized in that at least one of the component partners has a structure including grooves in its press area and/or the particular press area has an inlet rounding in at least one transition to an adjacent component section.

10 Claims, 3 Drawing Sheets

FUEL INJECTOR

FIELD OF THE INVENTION

The present invention is directed to a fuel injector.

BACKGROUND INFORMATION

A fuel injector is discussed in DE 199 00 405 A1 which includes an electromagnetic actuating element having a magnetic coil, an inner pole and an outer magnetic circuit component, and a movable valve-closure member which interacts with a valve seat assigned to a valve-seat member. The valve-seat member and inner pole are situated in an inner opening in a thin-walled valve sleeve, and the magnetic coil and outer magnetic circuit component are situated on the outer circumference of the valve sleeve. To mount the individual components in and on the valve sleeve, the magnetic circuit component designed in the form of a magnet pot is first pushed onto the valve sleeve, and the valve-seat member is then pressed into the inner opening in the valve sleeve in such a way that a fixed connection is established between the valve sleeve and the magnetic circuit component solely by pressing in the valve-seat member. After an axially movable valve needle is mounted in the valve sleeve, the inner pole is subsequently mounted by pressing it into the valve sleeve. If the magnetic circuit component is pressed onto the valve sleeve solely by pressing in the valve-seat member, the press connection is in great danger of separating. Pressing the inner pole into the valve sleeve produces unwanted cold welds in the press area.

SUMMARY OF THE INVENTION

The fuel injector according to the present invention, having the features described herein, has the advantage that it is particularly easy to manufacture inexpensively. According to the exemplary embodiments and/or exemplary methods of the present invention, the fixed press connection between at least two metallic components of the fuel injector is characterized in that at least one of the component partners has a structure including grooves in its press area and/or the particular press area has an inlet rounding in at least one transition to an adjacent component section.

It is advantageous that inexpensive components which are provided as deep-drawn or lathed parts may be used to produce press connections between metallic component partners, these connections remaining securely and reliably fast and tight over a long period of time without the formation of cold welds. The press connections are produced very easily and inexpensively, since known, separate operations which are usually needed, such as coating or lubrication to improve the joining of the component partners or heating of the component partners to achieve shrinkage, may be advantageously eliminated.

The further features described herein provide advantageous refinements of and improvements on the fuel injector described herein.

If the component partners are unable to expand or be compressed due to their rigidity, or if they are made of too soft a material, such as soft magnetic chromium steels, which are customarily used for a wide range of components in an electromagnetically driven fuel injector, cold welds (scoring) occur with a high degree of probability in known press connections during the press-in joining process, these cold welds, however, being avoided by the measures according to the exemplary embodiments and/or exemplary methods of the present invention, in particular in components made of soft magnetic chromium steel. According to the exemplary embodiments and/or exemplary methods of the present invention, it is possible to eliminate complex, precise and cost-intensive machining processes such as fine grinding or honing which may limit the component tolerances and require considerable effort to improve the press connections.

The metallic component partners to be pressed are washed in a particularly advantageous manner, at least in their respective press areas, using a cleaner. In conjunction with the grooves according to the exemplary embodiments and/or exemplary methods of the present invention, advantageous lubricant storage receptacles are produced in the particular press area. The anticorrosive universal cleaners SurTec® 104 and SurTec® 089 are advantageously used as cleaners.

Exemplary embodiments of the present invention are illustrated in the drawings and explained in greater detail in the following description.

DETAILED DESCRIPTION

To provide a better understanding of the features according to the exemplary embodiments and/or exemplary methods of the present invention, a fuel injector according to the related art, including its basic modules, is explained below on the basis of FIG. 1.

Figure 1:
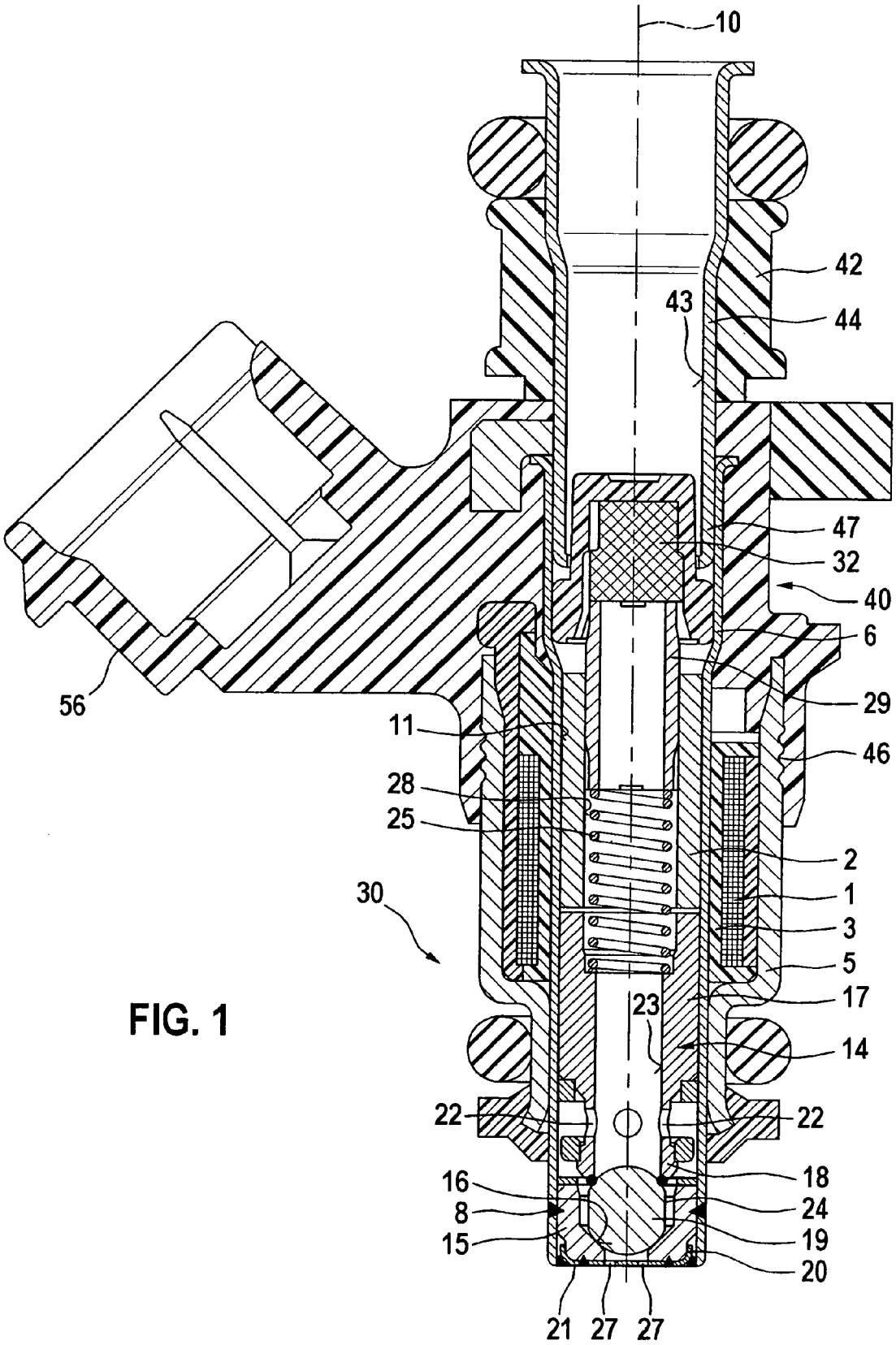
FIG. 1 shows a fuel injector according to the related art.

The electromagnetically operable valve in the form of an injector for fuel injection systems of mixture-compressing spark-ignition internal combustion engines, illustrated by way of example in FIG. 1, includes a largely tubular core 2 surrounded by a magnetic coil 1 which functions as an inner pole and, in part, as a fuel flow passage. Magnetic coil 1 is completely surrounded in the circumferential direction by an outer sleeve-shaped valve jacket 5 of a stepped design, made for example of a ferromagnetic material, which represents an outer magnetic circuit component in the form of a magnet pot and acts as an outer pole. Magnetic coil 1, core 2 and valve jacket 5 together form an electrically excitable actuating element.

While magnetic coil 1 embedded in a coil shell 3 surrounds a valve sleeve 6 from the outside, core 2 is introduced into an inner opening 11 in valve sleeve 6 which runs concentrically to a longitudinal valve axis 10. Valve sleeve 6, which is made for example of a ferritic material, has an elongated and thin-walled design. Opening 11 also acts as a guide opening for a valve needle 14 which is movable axially along longitudinal valve axis 10. Valve sleeve 6 extends in the axial direction, for example, over more than half the total axial length of the fuel injector.

In addition to core 2 and valve needle 14, opening 11 also accommodates a valve-seat member 15 which is attached to valve sleeve 6, for example, by a weld 8. Valve-seat member 15 has a fixed valve-seat surface 16 as the valve seat. Valve needle 14 is formed, for example, by a tubular armature section 17, an equally tubular needle section 18 and a spherical valve-closure member 19, valve-closure member 19 being permanently connected to needle section 18, for example by a weld. A, for example, pot-shaped perforated spray disk 21, whose folded over and circumferentially running edge 20 is directed upward against the direction of flow, is situated at the downstream end of valve-seat member 15. The fixed connection between valve-seat member 15 and perforated spray disk 21 is established, for example, by a circumferential, tight weld. One or more transverse openings 22 are provided in needle section 18 of valve needle 14, so that fuel flowing through armature section 17 into an inner longitudinal hole 23 may exit and flow to valve-seat surface 16 along, for example, flattened areas 24 on valve closing member 19.

The injector is operated electromagnetically in the known manner. The electromagnetic circuit, including magnetic coil 1, inner core 2, outer valve jacket 5 and armature section 17, is used to move valve needle 14 axially and thus to open the injector against the spring force of a restoring spring 25 engaging with valve needle 14 and to close the injector. Armature section 17 is aligned with the end of core 2 facing away from valve-closure member 19.

Spherical valve-closure member 19 interacts with valve-seat surface 16 of valve-seat member 15, which is tapered in the form of a truncated cone in the direction of flow and is provided downstream from a guide opening in valve-seat member 15 in the axial direction. Perforated spray disk 21 has at least one, for example four, spray openings 27 formed by spark erosion, laser drilling or punching.

The depth at which core 2 is inserted into the injector is decisive, among other things, for the lift of valve needle 14. One end position of valve needle 14 is defined by valve-closure member 19 coming to rest against valve-seat surface 16 of valve-seat member 15 when magnetic coil 1 is in the non-excited state, while the other end position of valve needle 14 is established by armature section 17 coming to rest against the downstream end of the core when magnetic coil 1 is in the excited state. The lift is set via the axial movement of core 2, which is manufactured, for example, by a machining operation such as lathing and is subsequently firmly connected to valve sleeve 6 according to the desired position.

In addition to restoring spring 25, an adjusting element in the form of an adjusting sleeve 29 is inserted into a flow hole 28 in core 2, which runs concentrically to longitudinal valve axis 10 and is used to supply fuel in the direction of valve-seat surface 16. Adjusting sleeve 29 is used to adjust the spring pre-tension of restoring spring 25, which rests against adjusting sleeve 29 and, in turn, supports valve needle 14 at its opposite end, adjusting sleeve 29 also being used to adjust the dynamic spray volume. A fuel filter 32 is situated above adjusting sleeve 29 in valve sleeve 6.

The injector described up to this point is characterized by a particularly compact design, resulting in a very small, practical injector. These components form an independent, preassembled module which is referred to below as function part 30. Function part 30 therefore includes, in principle, electromagnetic circuit 1, 2, 5 and a sealing valve (valve-closure member 19, valve-seat member 15) having a downstream jet processing element (perforated spray disk 21) as well as valve sleeve 6 as the base member.

A second module, which is referred to below as connecting part 40, is produced independently of function part 30. Connecting part 40 is primarily characterized in that it includes the electrical and hydraulic connection of the fuel injector. Connecting part 40, which is largely designed as a plastic part, therefore includes a tubular base member 42 as a fuel inlet port. A flow hole 43 in an inner connecting tube 44 in base member 42, which runs concentrically to longitudinal valve axis 10, acts as the fuel inlet and has fuel flowing through it in the axial direction from the inflow end of the fuel injector.

When the fuel injector is fully assembled, a hydraulic connection between connecting part 40 and function part 30 is established by aligning flow holes 43 and 28 of both modules to ensure the unobstructed flow of fuel. When connecting part 40 is mounted on function part 30, a lower end 47 of connecting tube 44 projects into opening 11 in valve sleeve 6 to increase connection stability. Plastic base member 42 may be sprayed onto function part 30 in such a way that the plastic directly surrounds parts of valve sleeve 6 and valve jacket 5. A secure seal between function part 30 and base member 42 of connecting part 40 is achieved, for example, by providing a labyrinth seal 46 on the circumference of valve jacket 5.

Base member 42 also includes an electrical connecting plug 56, which is also sprayed on. The contact elements are electrically connected to magnetic coil 1 at their ends diametrically opposed to connecting plug 56.

Figure 2:
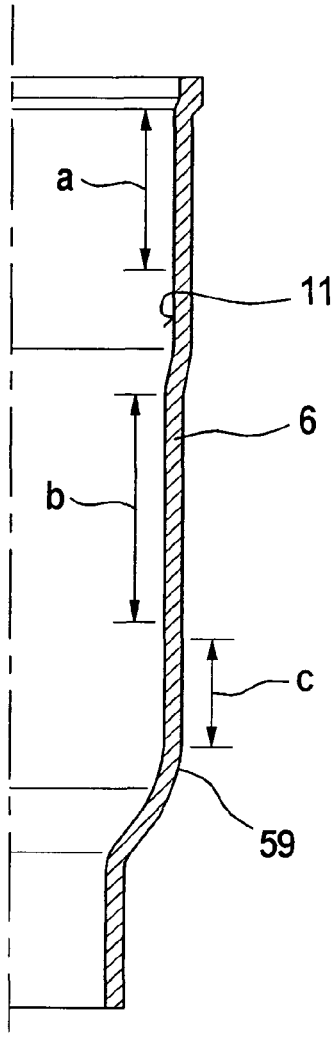
FIG. 2 shows a detailed view of a valve sleeve.
Figure 3:
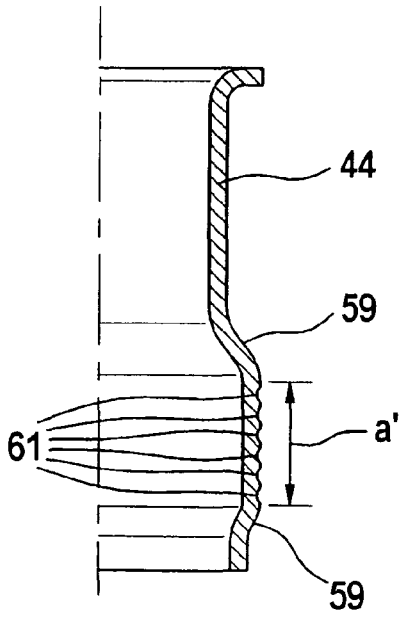
FIG. 3 shows a detailed view of a connecting tube.
Figure 4:
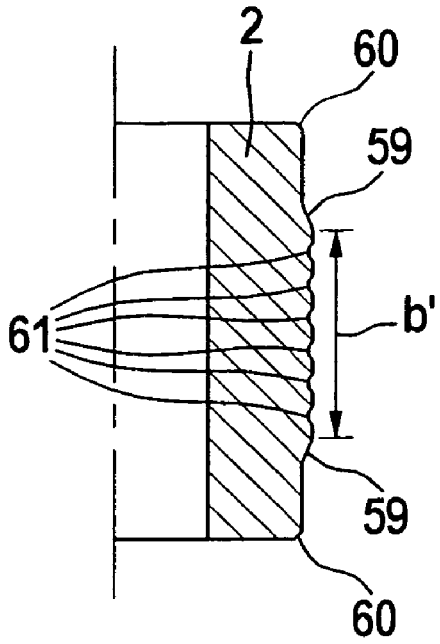
FIG. 4 shows a detailed view of a core serving as an inner pole.
Figure 5:
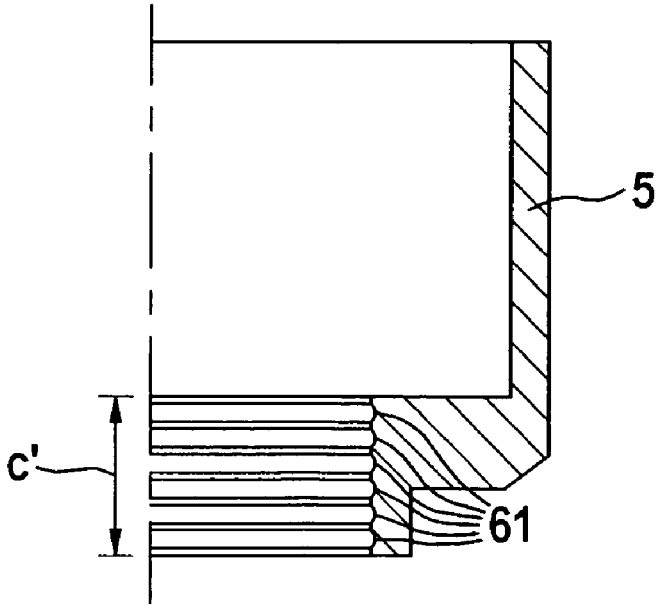
FIG. 5 shows a detailed view of a valve jacket in the form of a magnet pot.

FIGS. 2 through 5 show metallic components of the fuel injector, each of which is firmly connected to at least one other metallic component by pressing. FIG. 2 shows a detailed view of a valve sleeve 6; FIG. 3 shows a detailed view of a connecting tube 44; FIG. 4 shows a detailed view of core 2 serving as an inner pole; and FIG. 5 shows a detailed view of a valve jacket 5 in the form of a magnet pot.

Interference fits between the two components to be joined may be used to firmly interconnect metallic components in the fuel injector. However, interference fits generally result in plastic or elastic compressions or expansions in the components, depending on the position tolerance, material and component geometry. If the component partners are unable to expand or be compressed due to their rigidity, or if they are made of too soft a material, such as soft magnetic chromium steels, cold welds (scoring) occur with a high degree of probability during the press-in joining process. Attention must also be paid to the mounting conditions of the component partners. If an internal pressure is applied to the press connection, for example in the assembled state, expansion and stretching may occur. There is also the danger of the press connection loosening and, in the worst case, the connection separating. To avoid this, the greatest possible compressive force should be generated, which, however, also increases the tendency of the components to form cold welds. Complex, precise and cost-intensive machining processes, such as fine grinding and honing may, of course, help limit the component tolerances and improve the press connections.

However, the goal is to use inexpensive components which are provided as lathed parts to produce press connections between metallic component partners which remain securely and reliably fast and tight over a long period of time without forming cold welds. It must be possible, however, to produce the press connections very easily and inexpensively, which is why there is no separate coating or lubrication operation or heating of the component partners to achieve shrinkage.

FIG. 2 shows an example of a thin-walled valve sleeve 6 which extends over a large portion of the axial length of the fuel injector and into which connecting tube 44 (FIG. 3) is pressable in an area a and core 2 (FIG. 4) is pressable in an area b and onto which valve jacket 5 (FIG. 5) is pressable in an area c.

Correspondingly, when mounted in valve sleeve 6, connecting tube 44 according to FIG. 3 has an outer press area a' which corresponds to area a to form a press connection. Reference letters a and a' identify areas which may be used, in principle, for material contact in the press connection; however, the press connection in no way has to be formed along the entire length of a and a'. Connecting tube 44 should be mounted in valve sleeve 6 using the least possible press-in force. Forming a defined, short press area a' enables the press length to be minimized from the outset. Press area a' of connecting tube 44 has a raised design in relation to the adjacent sections of connecting tube 44. Inlet roundings 59 which have a relatively large radius are provided in the transition between press area a' and the sections following axially on both sides. The radii correspond, for example, to an angularity of approximately 0.50 to 1.20 in the transitions.

As an additional feature, for example, furrow- or channel-like grooves 61, which repeatedly interrupt the zones of possible cold welding, are provided on the surface of connecting tube 44 in press area a'. This largely avoids disadvantageous "scoring zones" in the press connection. Grooves 61, which, for example, are circumferential, also reduce high interference, since they are plastically deformed during pressing and flatten out slightly. However, the profile produced by grooves 61 must have sufficient rigidity to enable valve sleeve 6 to expand in the case of low interference.

Correspondingly, when mounted in valve sleeve 6, core 2 according to FIG. 4 has an outer press area b' which corresponds to area b to form a press connection. Reference letters b and b' identify areas which may be used, in principle, for material contact in the press connection; however, the press connection in no way has to be formed along the entire length of b and b'. When being pressed in, core 2 must produce a minimum expansion of valve sleeve 6; however, the maximum press-in force should be limited. Forming a defined, short press area b' enables the press length to be minimized from the outset. Press area b' of core 2 has a raised design in relation to the adjacent sections of core 2. Inlet roundings 59 which have a relatively large radius are provided in the transition between press area b' and the sections following axially on both sides. The radii correspond, for example, to an angularity of approximately 0.5° to 1.2° in the transitions. In each transition between the jacket surface of core 2 and its end faces, core 2 may also have a circumferential bevel 60, which is used to improve the insertion and centering of core 2.

Furrow- or channel-like grooves 61, which repeatedly interrupt the zones of possible cold welding, are provided on the surface of core 2 in press area b' instead of inlet roundings 59 or as an additional feature. This largely avoids disadvantageous "scoring zones" in the press connection. Grooves 61, which, for example, are circumferential, also reduce high interference, since they are plastically deformed during pressing and flatten out slightly. However, the profile produced by grooves 61 must have sufficient rigidity to enable valve sleeve 6 to expand in the case of low interference.

Correspondingly, when mounted on valve sleeve 6, valve jacket 5 according to FIG. 5 has an inner press area c' which corresponds to area c to form a press connection. Reference letters c and c' identify areas which may be used, in principle, for material contact in the press connection; however, the press connection in no way has to be formed along the entire length of c and c'. Furrow- or channel-like grooves 61, which repeatedly interrupt the zones of possible cold welding, are provided on the surface of valve jacket 5 in press area c'. This largely avoids disadvantageous "scoring zones" in the press connection. Grooves 61, which, for example, are circumferential, also reduce high interference, since they are plastically deformed during pressing and flatten out slightly. However, the profile produced by grooves 61 must have sufficient rigidity to enable a slight plastic deformation of valve sleeve 6 in the case of low interference. Forming a defined, short press area c' enables the press length to be minimized from the outset. Unlike the illustration in FIG. 5, press area c' of valve jacket 5 may also have a raised design in relation to the adjacent sections of valve jacket 5, which defines maximum press area c' even more precisely.

An inlet rounding 59 which has a relatively large radius is provided on valve sleeve 6, for example on an axial side of the transition in press area c. The radius corresponds, for example, to an angularity of approximately 0.5° to 1.2° in the transition.

In addition to the measures according to the exemplary embodiments and/or exemplary methods of the present invention to establish a fixed press connection between at least two metallic components 2, 5, 6, 44 of the fuel injector by providing a structure including grooves 61 in press area a, b, c, a', b', c' and/or by including an inlet rounding 59 in at least one transition between particular press area a, b, c, a', b', c' and an adjacent component section, a further measure may particularly effectively help improve the metallic press connection, while avoiding disadvantageous cold welds. For this purpose a "dry coating" is provided in particular desired press area a, b, c, a', b', c', in which press area a, b, c, a', b', c' is treated with an industrial cleaner, e.g., a washing emulsion, in a washing operation. Components 2, 5, 6, 44 selected for this purpose are washed, for example by immersion, spraying or dripping. For example, the neutral universal cleaner SurTec® 104, which may customarily be used as an anticorrosion agent, has an excellent degreasing action and reacts very mildly on metallic surfaces, is particularly suitable for a washing operation of this type. A 10% SurTec® 104 solution is ideally used in treating press area a, b, c, a', b', c'. Grooves 61 according to the exemplary embodiments and/or exemplary methods of the present invention in press areas a, b, c, a', b', c' act as lubricant storage receptacles.

SurTec® 089, a modular universal cleaner including surfactant components, may also be used, for example, as an alternative to the universal cleaner SurTec® 104. The cleaner SurTec® 089 having surfactants and anti-corrosive components is particularly suitable for immersion cleaning. Due to treatment by universal cleaners of this type, metallic components 2, 5, 6, 44 are cleaned even prior to assembly and are protected against corrosion by passivation. Following the washing operation, components 2, 5, 6, 44 are dried, for example, using vacuum driers.

What is claimed is:

1. A fuel injector for a fuel injection system of an internal combustion engine, comprising:

a valve-seat member;

a valve-closure member; and an excitable actuator for operating the valve-closure member, along a longitudinal valve axis, the valve-closure member interacting with a valve-seat surface provided on the valve-seat member, and having at least one spray opening and metallic components which are firmly connected to one another by pressing, wherein the fixed press connection between at least two metallic components of the fuel injector is arranged so that at least one of the metallic components has a structure including grooves in at least one of its press area and a particular press area has an inlet rounding in at least one transition to an adjacent component section;

wherein at least one of the metallic components of the fixed press connection is a thin-walled valve sleeve situated between an inner pole and an outer pole of the excitable actuator.

2. The fuel injector of claim 1, wherein the grooves in the press area are circumferential.

3. The fuel injector of claim 1, wherein the press area has a raised configuration in relation to the adjacent component section.

4. The fuel injector of claim 3, wherein the inlet rounding has a radius that corresponds to an angularity of 0.5° to 1.2° in the transition.

5. The fuel injector of claim 1, wherein at least one of: (a) a connecting tube is pressed into the valve sleeve; (b) a core is pressed into the valve sleeve; and (c) a valve jacket is pressed onto the valve sleeve.

6. The fuel injector of claim 1, wherein the valve sleeve has an axial extension which is equal to more than half a total axial length of the fuel injector.

7. The fuel injector of claim 1, wherein the valve sleeve is a deep-drawn sheet metal part.

8. The fuel injector of claim 1, wherein the metallic components interconnected by the fixed press connection are made of a soft magnetic chromium steel.

9. The fuel injector of claim 1, wherein the metallic components are washed with a cleaner at least in their particular press areas.

10. A fuel injector for a fuel injection system of an internal combustion engine, comprising:

a valve-seat member;

a valve-closure member; and an excitable actuator for operating the valve-closure member, along a longitudinal valve axis, the valve-closure member interacting with a valve-seat surface provided on the valve-seat member, and having at least one spray opening and metallic components which are firmly connected to one another by pressing, wherein the fixed press connection between at least two metallic components of the fuel injector is arranged so that at least one of the metallic components has a structure including grooves in its press area;

wherein the press area has an inlet rounding in at least one transition to an adjacent component section, and the press area has a raised configuration in relation to the adjacent component section;

wherein the inlet rounding has a radius that corresponds to an angularity of 0.5° to 1.2° in the transition.

* * * * *